United States Patent [19]

Griset, Jr.

[11] 4,051,660

[45] Oct. 4, 1977

[54] YARNS AND THEIR METHOD OF MANUFACTURE

[75] Inventor: Ernest Griset, Jr., Asheville, N.C.

[73] Assignee: Akzona Incorporated, Asheville, N.C.

[21] Appl. No.: 717,737

[22] Filed: Aug. 24, 1976

Related U.S. Application Data

[63] Continuation of Ser. No. 488,878, July 15, 1974, abandoned, and a continuation-in-part of Ser. No. 211,997, Dec. 27, 1971, Pat. No. 3,823,449.

[51] Int. Cl.[2] ..... D01H 1/00; D01H 7/92

[52] U.S. Cl. ..... 57/140 BY; 57/34 AT; 57/140 R; 57/157 R; 57/157 F; 28/275

[58] Field of Search ..... 57/34 R, 34 HS, 34 B, 57/34 AT, 140 R, 140 BY, 157 R, 157 TS, 157 MS, 157 F; 28/1.4

[56] References Cited

U.S. PATENT DOCUMENTS

| | | | |
|---|---|---|---|
| 2,990,671 | 7/1961 | Bunting et al. | 57/157 F X |
| 3,116,588 | 1/1964 | Breen et al. | 57/157 F |
| 3,309,855 | 3/1967 | Stoll et al. | 57/140 BY X |
| 3,460,336 | 8/1969 | Collingwood et al. | 57/157 F X |
| 3,775,955 | 12/1973 | Shah | 57/34 AT |
| 3,796,035 | 3/1974 | Watson | 57/140 BY |
| 3,811,263 | 5/1974 | Newton | 57/140 BY X |

*Primary Examiner*—Donald Watkins
*Attorney, Agent, or Firm*—Francis W. Young; Tom R. Vestal

[57] ABSTRACT

Disclosed are novel yarns comprised of at least two, and preferably three, strands of filaments, being twisted about the other strands in random "*s*" and "*z*" directions in variant degress with filaments of each strand being interlaced together to produce a cohesive commingled yarn. The individual strands although interlaced with the other strands maintain substantial integrity in the commingled yarn and preferably have different dye affinities. Methods of manufacturing the novel yarns are also disclosed.

21 Claims, 8 Drawing Figures

YARNS AND THEIR METHOD OF MANUFACTURE

This is a continuation of application Ser. No. 488,878, filed July 15, 1974, now abandoned, and is a continuation in part of U.S. Patent Application Serial No. 211,997, filed December 27, 1971, now Letters Patent No. 3,823,449.

The parent case discloses an apparatus for interlacing yarns wherein use is made of indentations or "dimples" in the yarn channel of an air jet to enhance turbulent action of fluid currents introduced into the yarn channel proximate the indentations. Novel methods of making yarns were also disclosed in U.S. Pat. No. 3,823,449, and it has been found that these yarns have particularly novel and interesting effects when tufted into carpet structures or woven or knitted into fabric structures. In particular, it has been found that carpets and fabrics made from yarns according to the methods disclosed therein exhibit random long or short striations throughout depending on the particular method of interlacing practiced.

For a better explanation of the invention herein, reference is made to the following drawings.

Figure 1:
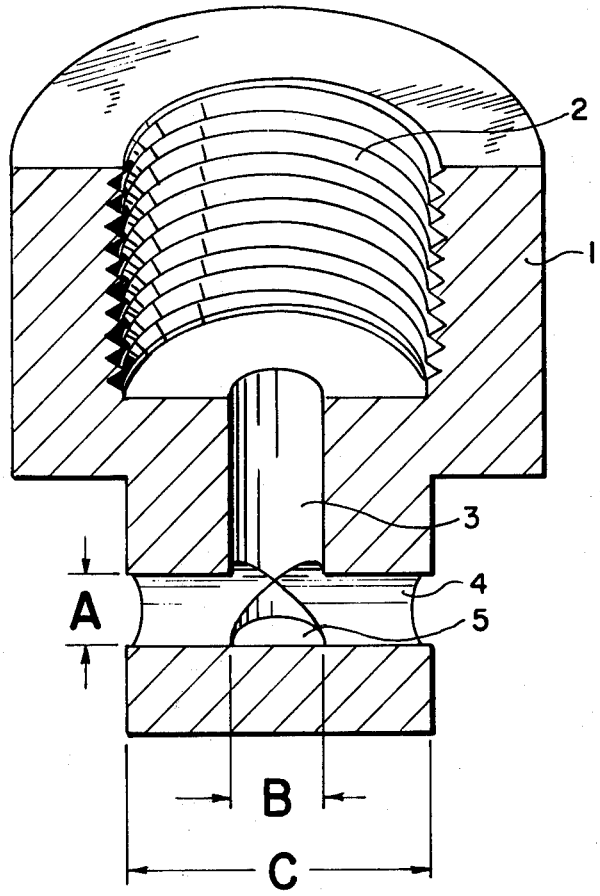
FIG. 1 shows a cross-sectional view of the interlacing jet particularly adaptive to making the yarns of the present invention.

In FIG. 1 a circular yarn channel 4 of diameter A and length C is contained in a body 1. A fluid channel 3 of diameter B connects the yarn channel 4 with a thread channel 2 where fluid supply means (not shown) can be attached to the body. A "dimple" 5 is formed in the yarn channel, preferably of the same diameter B as fluid channel 3. The body 1 may be constructed of any suitable material resistant to yarn abrasion and either cast or machined.

Figure 2:
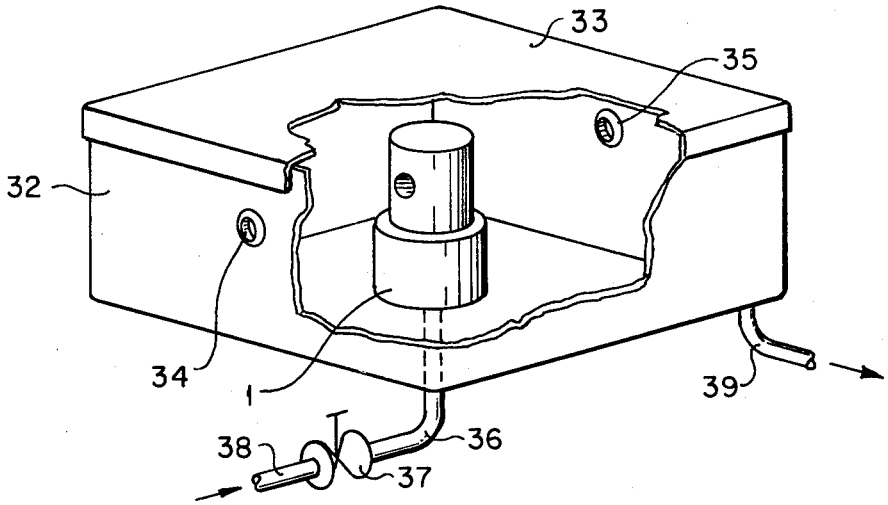
FIG. 2 is one embodiment of the jet apparatus of the invention.

FIG. 2 is an example of one particular embodiment of the apparatus utilized wherein a pressurized fluid comprising both a liquid and a gas may be used. The liquid may be saturated steam and the gas may be air. A container 32 of any suitable material with removable cover 33 contains eye guides 34 and 35. An interlacing device 1 similar to that shown in FIG. 1 is mounted within the container in alignment with eye guides 34 and 35. The fluid mixture from a supply 38 is directed to the interlacing device 1 along supply line 36 through control valve 37. Container 32 should be sufficient in size to allow ample expansion of the fluid mixture. After expansion, the residue liquid and gas may be removed from container 32 along line 39.

Figure 3:
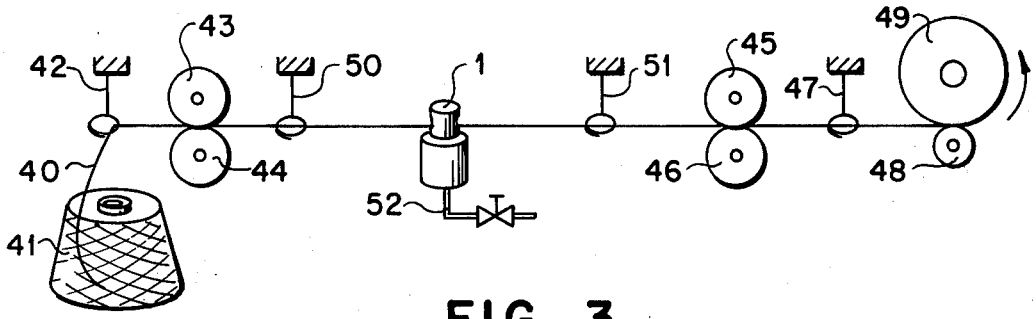
FIG. 3 and FIG. 4 are alternative embodiments of the method utilized herein.

In FIG. 3, yarn 40 comprising one or more ends is withdrawn from package 41, through an eyelet guide 42 by feed rollers 43 and 44. Rollers 45 and 46 withdraw the yarn from feed rollers 43 and 44 at the desired tension. Generally, a slight overfeed from rollers 43 and 44 is desired to create a bulkiness in the yarn. Less overfeed tends to produce less bulkiness in the interlaced yarn and is useful for certain effects herein. Eyelet guides 50 and 51 align the yarn 40 with the interlacing device 1 into which pressurized fluid is injected through supply line 52. The interlaced yarn is then forwarded through eyelet guide 47 and wound into a package 49 by winding means 48.

Figure 4:
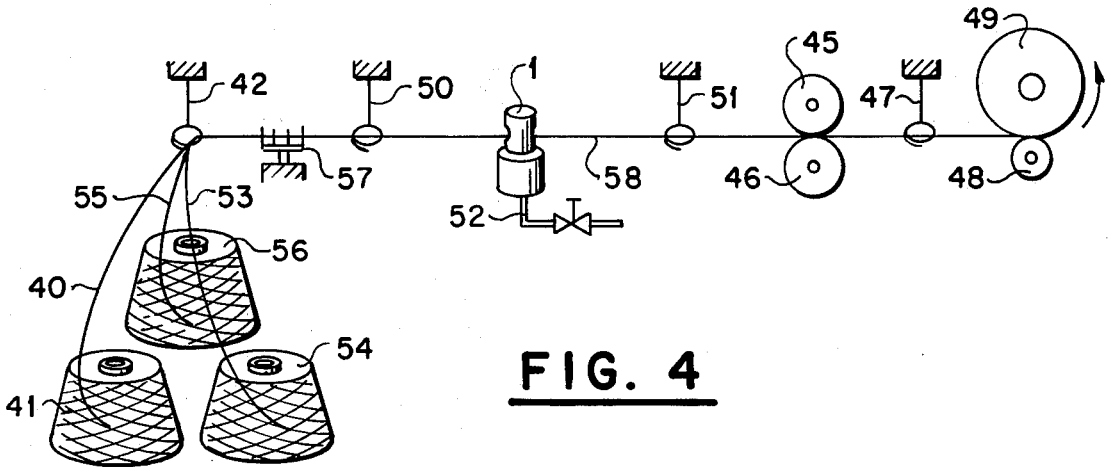

In FIG. 4 three ends of yarn 40, 53, and 55 are withdrawn from packages 41, 54, and 56 through eyelet guide 42 and pass through a tension device 57. The yarns may then pass through the interlacing device 1. The yarn 58 emerging from the interlacing device, a blend of the yarns 40, 53, and 55, is passed through to wind-up in a package as in FIG. 3.

It has been discovered that the yarn produced according to the methods disclosed herein can vary extensively depending on the yarn tension through the jet, jet fluid pressure, and yarn speed through the jet, the first two having the most effect. There are certain characteristics of yarn produced through the instant apparatus which occur throughout the yarn and lend the yarn particularly useful for certain tufted carpet structures and textile fabrics.

Figure 5:
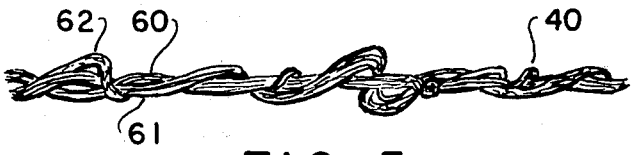
FIGS. 5 and 6 are examples of interlaced yarn.

The yarn according to FIG. 5 was produced by combining three ends of yarn 60, 61, and 62 in the method disclosed in FIG. 3 at relatively low fluid pressures and a slight overfeed. It is noted that the individual strands retain their integrity but are whipped and interleaved to produce a coherent unitary strand structure 40. The interleavings of each individual strand follow a random and alternating twisting with the other strands, commonly called "*s*" and "*z*" twist in the trade. The twisting action of each individual strand around the unitary yarn strand 40 may vary from only a few degrees of revolution to a number of revolutions per unit length of the unitary yarn strand. Each individual strand maintains a specific separate spatial relationship with the other strands, however. Strand 60 may appear predominately on one side of the unitary strand 40 for a certain unit length; then, the twisting action of the jet in the process herein may rotate the strands in a manner so that strand 61 will appear predominately on the side where strand 60 previously was positioned. Furthermore, the twisting action may be so small or may be offset by substantially similar sequential "*s*" and "*z*" twists that segments of yarn may appear to have virtually no twist.

The strand shown in FIG. 5 is particularly suitable for textile fabric end use. For example, yarn 40 composed of three differently colored or shaded yarn singles is used as a filler yarn in a woven fabric; the predominance of one color or shade will appear across the warp as striations against the general background of the warp and create a novel and pleasing effect in the fabric.

By selecting shades and colors, a myriad of fabric effects from sharp color contrast to more subtle tone on tone variations may be obtained. The strands in the yarn herein may be separately dyed prior to being combined by the method set forth herein. Also, the strands may be composed of filaments having different dye affinity from the other strands of the commingled yarn. "Dye affinity" as used herein refers to the rate of absorption and/or degree of receptivity of dye level. For example, filaments of different materials generally have different dye affinity. Methods are also known for treating filaments of similar material to obtain different absorption rates and dye levels.

Figure 6:
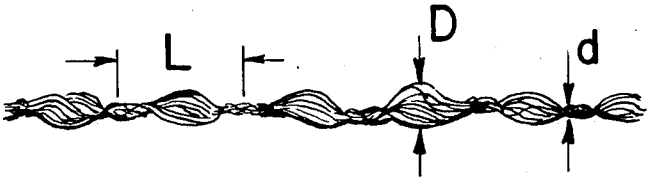

The yarn 58 in FIG. 6, was produced by combining three ends of yarn 40, 53, and 55 in the method disclosed in FIG. 4 at higher fluid pressures and greater overfeed, producing alternating tight and open sections as depicted. The individual filaments within the strands 40, 53, and 55 are more widely separated than the filaments of FIG. 5. It has been observed that the twisting action of the jet described earlier appears to be concentrated in the tight sections of this particular embodiment. Furthermore, the separate strands may pass through a number of nodal points varying to a great degree from their spatial relation with respect to each other in the unitary strand 58. For example, strand 55 may be positioned on one side of the unitary strand at a given point. At the first tight spot or nodal point away, the strand 55 may be twisted in the "*z*" direction around strand 58 a few degrees but still be basically positioned on the same side as earlier. At the second tight spot or nodal point, the strand may be twisted in the "*s*" direction a few degrees more than through the first tight spot, ending with strand 55 still basically positioned on the same side of unitary strand 58, etc., until either a combination of similar twists or a large twist in one direction positions either strand 40 or 53 in the side position formerly occupied by strand 55.

The rotation of the separate strands just described may occur over some length. If, for example, two strands of light and one strand of dark yarn are combined by either the method of FIG. 3 or FIG. 4, fabrics knitted from the yarn will exhibit dark streaks or striations when the dark strand is positioned on the outside of the fabric versus a light background when either of the lighter strands are positioned on the outside of the fabric.

Figure 7:
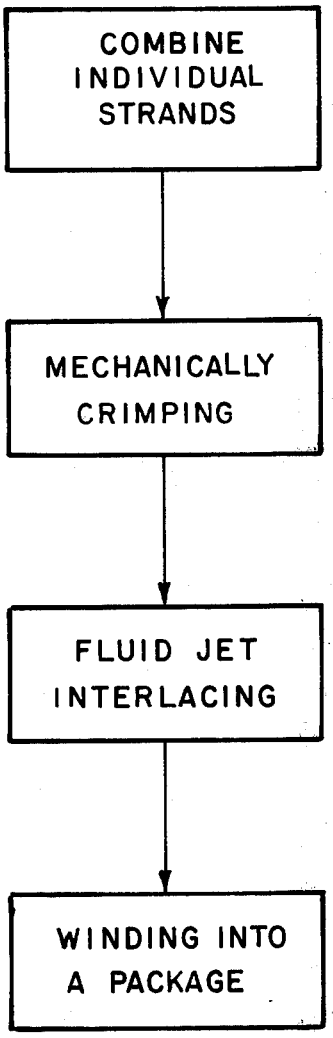
FIGS. 7 and 8 are block diagrams of alternative embodiments of the method utilized herein.
Figure 8:
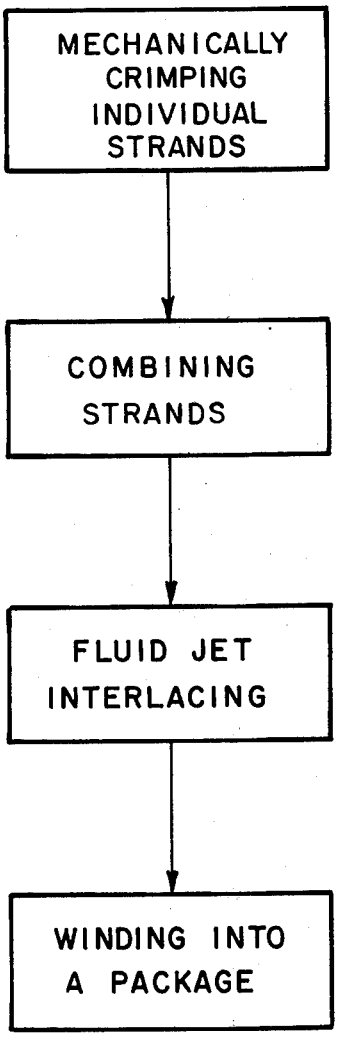

If one or more of the strands have been mechanically crimped prior to being subjected to the jetting action of the present disclosure as depicted by the block diagrams of FIG. 7 and FIG. 8, the interleaving of the individual filaments of each strand is restricted in the method of FIG. 6. Nevertheless, sufficient interlacing and entanglement of the filaments can be obtained to make a unitary strand, albeit the nodal points discussed above are less prevalent and further apart. The separate strands will exhibit the alternate and random twisting action discussed earlier, however, and crimped yarn combined accordingly is randomly patterned along its length.

The random patterning of crimped yarn processed according to the present disclosure is especially useful in making yarns for uncut pile carpeting. The manufacture of such carpeting is well known. Briefly, however, one process comprises tufting of a carpet yarn into a carpet backing, a woven or nonwoven fabric, by punching the carpet yarn at successive intervals along its length through the backing at regular determined intervals and loop depth, the loop being formed from the carpet yarn extending through the punched hole in the carpet backing. Normally, and depending on the weight carpet, the loops so made will be in rows closely adjacent each other and the tops of the loops will present to the eye a uniform surface — the top surface of the carpet.

In some carpet construction, the loops are sheared, or cut, so that all filaments extend upward in random fashion. In the construction more advantageously used by the present invention, the loops are not cut, however, and the top strands of the looped yarn will be visible, while the lower strands will be masked or hidden by adjacent looped structures. Carpets so constructed and utilizing yarns made as disclosed herein will have striated or grainy effects in the surface of the carpet when the color or tone of the individual strands of the yarn are variant.

EXAMPLE

Three ends of 1040 denier, 68 filament "0" twist nylon 6 yarn were passed individually through a stuffer crimping device, mechanically crimped and wound into separate packages. One end was dyed a burnt orange; one dyed pale yellow; and one end remained white. The three ends were combined in the method shown in FIG. 4 and passed through the jet of FIG. 1 at 600 yards/min. with overfeed. Jet pressure was 30 PSIG. The resultant yarn showed crimp deregistration of the individual strands and sufficient entanglement to cause cohesiveness between the strands. Additionally, the strands were approximately parallel along the yarn length with random twisting of the strands around the yarn axis of a few degrees to a number of degrees per unit length. The burnt orange strand in one 17 inch sample of yarn had the following twist relative to the other strands (the yarn was considered viewed from the end with its total cross-section divided into quadrants):

| Length | Type Twist | Quadrants Strand Appeared |
|---|---|---|
| 3" | O | 2 |
| 5" | "z" | 2,1 |
| 1" | "s" | 2, 4, 3, 1 |
| 1¾" | "s" | 2 |
| 6¼" | "z" | 2, 1 |

When tufted into a carpet, the burnt orange strands showed up in the carpet as striations against the lighter yellow and white background. When the burnt orange strands appeared on top side by side in simultaneous rows, a wide striated effect occurred, whereas a step or broken striation effect occurred when segments of burnt orange striations in adjacent rows overlapped at these end points. The striations in a single tufted row ranged from one inch to five inches in length along the row.

Twist level in the yarns herein should be minimal so that the random twisting action of the jet will not be overcome. The twist level of the combined yarns should be below one turn per inch. Preferably, a "producer's twist" of ¼ to ¼ turn per inch is utilized in the embodiment when the strands are twisted prior to being commingled. Package takeup devices preferably should have little or no twist, and twisting in further processing should be avoided. Other embodiments of the invention herein described may be apparent to those skilled in the art upon reading the present specification and it is not intended that the invention herein be limited to what is disclosed but to what is set forth in the claims that follow.

What is claimed:

1. The method of interlacing a plurality of strands into a commingled yarn comprising the steps of combining the plurality of strands in parallel from a supply source, then twisting the individual strands within the combination in random "*s*" and "*z*" directions in variant degrees about each other while simultaneously interlacing filaments of an each strand with filaments of adjacent strand to entrap the random twists in the commingled single yarn while maintaining substantial integrity of each strand, and thereafter winding into a package.

2. The method of claim 1, including after combining the plurality of yarns in parallel but before twisting the individual strands in random "*s*" and "*z*" directions of variant degrees, the additional step of pretwisting said combining yarns less than one turn per inch.

3. The method of interlacing a plurality of strands of claim 1 wherein at least one strand prior to twisting in random "s" and "z" directions of variant degrees is differently colored than the other strands.

4. A method of interlacing a plurality of strands wherein at least one strand has a different dye affinity than the other strands, comprising the method of claim 1.

5. The method of interlacing a plurality of strands comprising the steps of claim 1, including mechanically crimping each strand prior to combining said plurality of strands.

6. The method of interlacing a plurality of strands of claim 1 including mechanically crimping the plurality of strands after combining, but before twisting in random "s" and "z" directions of variant degrees.

7. The method of making a novelty yarn composed of at least three strands of synthetic linear polymeric filaments comprising the steps of combining the strands in parallel from their sources of supply, twisting the individual strands about each other along their lengths in random "s" and "z" directions of variant degrees, including no twist, while simultaneously interlacing filaments of each strand with filaments of adjacent strands to entrap the random twists in a cohesive commingled yarn.

8. The method of making the novelty yarn of claim 7, further comprising combining at least two strands of different and distinct color or shade of color according to the steps of said claim.

9. The method of making the novelty yarn of claim 7, including the step prior to combining said strands in parallel, of mechanically crimping at least one strand.

10. The method of making the novelty yarn of claim 7, comprising the additional step of mechanically crimping the strands after combining but before twisting said strands in random variant degrees.

11. The method of making the novelty yarn of claim 7, comprising the additional step, after combining said strands, of pretwisting said combined strands less than one turn per inch.

12. The method of making the novelty yarn of claim 11, comprising pretwisting said combined strands between ¼ and ½ turn per inch.

13. A method of interlacing a plurality of continuous strands of yarn filaments into a single commingled yarn comprising the steps of continuously feeding said strands under tension to a confined yarn interlacing zone, injecting a gas under pressure in a turbulent manner into said confined yarn interlacing zone to agitate and twist the strands about each other along their lengths in random "s" and "z" directions of variant degrees, including no twist, while simultaneously interlacing filaments of each strand with filaments of adjacent strands to entrap the random twists in a cohesive commingled yarn.

14. The method of claim 13 including feeding said strands of yarn substantially parallel into said yarn interlacing zone.

15. The method of claim 13, including feeding said strands of yarn into said yarn interlacing zone with less than one turn per inch twist.

16. The method of claim 13, including simultaneously injecting with said gas under pressure a heated fluid into said confined yarn interlacing zone.

17. A novel yarn comprised of at least two strands of filaments twisted in random "s" and "z" directions in variant degrees of twist along their lengths, including sections of no twist, and having filaments of each strand simulaneously interlaced with filaments of adjacent strands to entrap the random twists in a cohesive, commingled yarn.

18. The novel yarn of claim 17, wherein at least one strand is comprised of filaments of different dye affinity.

19. The novel yarn of claim 17, wherein at least one strand has been mechanically crimped.

20. The novel yarn of claim 17, wherein said yarn is comprised of three strands, each strand having a different dye affinity and at least one strand having a much greater dye affinity than the other two strands.

21. A novel yarn comprised of three strands of filaments which have been mechanically crimped and then twisted in random "s" and "z" directions in variant degrees of twist along their lengths, including sections of no twist, and having filaments of each strand interlaced with filaments of adjacent strands to entrap the random twists in a cohesive, commingled yarn, the filaments of each strand having different dye affinities.

* * * * *